US005939233A

United States Patent [19]

Husain et al.

[11] Patent Number: 5,939,233

[45] Date of Patent: Aug. 17, 1999

[54] NUCLEATING AGENTS FOR GRAPHIC ARTS FILMS

[75] Inventors: Syeda Husain, Middletown; John F. Pilot, Carteret; Rajendra J. Shah, North Bergen, all of N.J.

[73] Assignee: Kodak Polychrome Graphics LLC, Norwalk, Conn.

[21] Appl. No.: 09/181,125

[22] Filed: Oct. 28, 1998

Related U.S. Application Data

[63] Continuation-in-part of application No. 08/858,158, Apr. 17, 1997, abandoned.

[51] Int. Cl.[6] ..... G03C 1/06; G03C 5/315

[52] U.S. Cl. ..... 430/265; 430/264; 430/448; 430/598

[58] Field of Search ..... 430/264, 265, 430/448, 598

[56] References Cited

U.S. PATENT DOCUMENTS

| | | | |
|---|---|---|---|
| 3,730,727 | 5/1973 | Olivares et al. | 430/566 |
| 4,224,401 | 9/1980 | Takada et al. | 430/437 |
| 4,269,929 | 5/1981 | Nothnagle | 430/264 |
| 4,686,167 | 8/1987 | Resnick et al. . | |
| 4,798,780 | 1/1989 | Hall et al. | 430/264 |
| 4,882,261 | 11/1989 | Kojima et al. | 430/264 |
| 4,937,160 | 6/1990 | Ruger | 430/264 |
| 4,975,354 | 12/1990 | Machonkin et al. | 430/264 |
| 4,988,604 | 1/1991 | Machonkin et al. | 430/264 |
| 4,994,364 | 2/1991 | Inoue et al. | 430/598 |
| 5,126,227 | 6/1992 | Machonkin et al. | 430/264 |
| 5,264,323 | 11/1993 | Purol et al. | 430/264 |
| 5,288,590 | 2/1994 | Kuwabara et al. | 430/264 |
| 5,316,890 | 5/1994 | Okamura et al. | 430/264 |
| 5,380,942 | 1/1995 | Husain et al. | 564/59 |
| 5,439,776 | 8/1995 | Pilot et al. | 430/264 |
| 5,451,486 | 9/1995 | Pilot et al. | 430/264 |
| 5,589,323 | 12/1996 | Adkins et al. | 430/492 |

OTHER PUBLICATIONS

James, T.H. "The Theory of the Photographic Process", 4th Ed., Chapter 17, pp. 481–516, MacMillan, New York (1977).

*Primary Examiner*—Mark F. Huff
*Attorney, Agent, or Firm*—Ratner & Prestia

[57] ABSTRACT

Nucleating agents that promote high contrast in photographic films are disclosed. The nucleating agents are aryl sulfonamido hydrazides having pyridinium, phosphonium or cycloalkenylpyridinium functional groups. The nucleating agents increase the speed and contrast of graphic arts films and improve dot quality in halftone applications. Boosters are not required to obtain good dot quality and photographic speed.

33 Claims, No Drawings

NUCLEATING AGENTS FOR GRAPHIC ARTS FILMS

CROSS-REFERENCE TO RELATED APPLICATIONS

This application is a continuation-in-part of Ser. No. 08/858,158, filed Apr. 17, 1997, incorporated herein by reference now abandoned.

FIELD OF THE INVENTION

The invention relates to nucleating agents used in photographic films to promote high contrast development, to photographic elements useful as graphic arts films containing such agents, and to a process for imaging using the photographic elements.

BACKGROUND OF THE INVENTION

The use of silver halide technology in the Graphics Arts Industry has been primarily focused on the creation of high contrast systems, which are necessary to obtain strong image discrimination and good image quality/dot characteristics. The earliest high contrast system, called the "lith" system, used a low sulfite, hydroquinone based developer with silver chlorobromide emulsions, further modified by polyethylene oxide compounds.

Although the lith system provides high contrast, excellent image discrimination and good "dot" characteristics, the developer is unstable. The system requires a multi-part, compound developer and a low temperature (75–80° F.) processing solution in order to maintain controlled developing conditions. These conditions require long processing times, sometimes as much as 2 minutes for development, but more commonly 1 minute. The process is further complicated by the fact that non-lith films are frequently processed in the same developers due to convenient configurations at various customers.

To increase development rates and reduce processing times, the Graphics Arts Industry gravitated toward the use of auxiliary developing agents in addition to hydroquinone. These agents include metol, phenidone, and the like. To increase developer life, the developing solutions employed higher concentrations of sulfite, which also increased their resistance to air oxidation, afforded greater uniformity of developer condition, and increased the development rate by allowing an increase in the temperature of the processing solution. These new "rapid access" developers were simpler to maintain and required about 30 seconds of development time, affording faster throughput, ease of operation, and greater compatibility with non-lith type films. The greatest drawback of these systems is the lack of the excellent image discrimination and dot characteristics achieved with the lith system.

U.S. Pat. No. 3,730,727 describes the use of formyl phenylhydrazines in the developer to improve image discrimination without the use of the low-sulfite lith techniques. U.S. Pat. No. 4,224,401 describes a lith-type result with a high pH, high sulfite-type developer solution. In U.S. Pat. No. 4,269,929, the system was further refined by the use of alkanol amines to lower the operable pH of the developer to practical levels, thus permitting commercialization of the type of developer known as "hybrid" developer. Hybrid developers provide the results of lith developers but at rapid access developing speeds.

Subsequently, U.S. Pat. Nos. 4,686,167, 4,798,780, 4,937,160, and 4,882,261, all teach novel hydrazine nucleators that afford the hybrid effect. Although hybrid systems have been commercialized, the alkanol amines used to boost or promote high contrast, require a pH of 11.0 or greater. This high pH has an adverse effect on the process equipment and is incompatible with the great variety of non-hybrid lithographic films that are frequently processed in the same chemistries.

U.S. Pat. Nos. 4,975,354 and 4,994,365 describe a new hybrid system that removes the alkanol amines from the developer and positions them in the film. These amines, ostensibly called boosters, activate the film incorporating the hydrazine nucleators, making them compatible with standard, low cost developing solutions.

The drawback of systems that incorporate alkanol amine boosters into the film containing the nucleators is the complexity of balancing the nucleator with the boosters to provide good discrimination at low fog or pepper levels while broadening the degree of compatibility with a number of existing rapid access developer systems. U.S. Pat. No. 5,264,323 describes the complications of balancing the hybrid systems which involves both nucleator and booster.

U.S. Pat. No. 4,994,365 describes the use of alkyl-ballasted quaternary pyridine nucleators, compatible with the boosters, which afford good discrimination and dot quality. However, interaction between the nucleator and booster makes the system incompatible with many rapid access systems.

U.S. Pat. No. 4,975,354 first described the use of "booster" technology, and U.S. Pat. No. 4,994,365 describes the use of alkyl ballasted pyridine nucleators as a method to improve image quality with the incorporated boosters.

U.S. Pat. No. 5,451,486, incorporated herein by reference, describes aryl sulfonamidophenyl hydrazides having alkenyl pyridinium functionality that offers improved performance as contrast enhancing nucleators.

U.S. Pat. No. 5,439,776, incorporated herein by reference, describes isothiouronium salts that serve as photographic nucleating agents and advances the use of substituted hydrazines as contrast enhancing nucleators.

Thus, a need exists for nucleator compounds having contrast enhancing properties superior to those previously disclosed along with high dot quality and film speed.

SUMMARY OF THE INVENTION

A series of photographic contrast enhancing agents or nucleators has been discovered that produce better dot contrast characteristics in imagewise exposed films and offer wider compatibility with standard rapid access developers. These nucleator compounds have contrast enhancing properties superior to those previously disclosed along with high dot quality and film speed.

More particularly, in one aspect the invention is a nucleating agent (nucleator) for photographic film comprising substituted hydrazine of the structure:

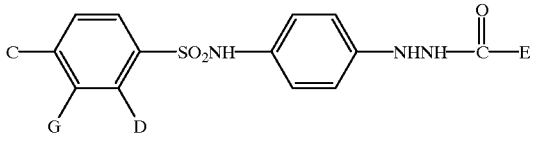

I wherein:

C is hydrogen, $C_1$–$C_3$ alkyl, or Z;

D is hydrogen or $C_1$–$C_3$ alkyl;

G is hydrogen or Z;

E is selected from hydrogen, morpholino($C_1$–$C_3$) alkylaminocarbonyl, morpholinoaminocarbonyl, and alkyl-substituted piperidylaminocarbonyl;

Z has the general structure:

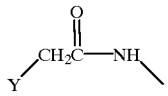

II

Y has the general structure:

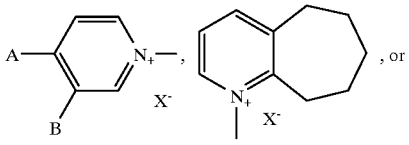

III IV

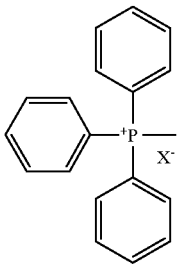

V wherein:

A is selected from hydrogen, alkyl, cycloalkenyl, piperidyl, alkylpiperidyl, arylalkyl and $C_4$–$C_{12}$ alkadienyl;

B is selected from hydrogen, unsubstituted benzyl, unsubstituted alkyl, alkoxy substituted benzyl, and halogen substituted benzyl; and X is an inorganic or organic anion;

with the provisos that:

A and B are not both hydrogen;

when C is Z, then D and G are hydrogen; and when G is Z, then C is either hydrogen or $C_1$–$C_3$ alkyl;

when E is hydrogen and G is Z, then A is hydrogen, piperidyl, or alkylpiperidyl.

In one embodiment, one of A and B is hydrogen. In one embodiment, when B is benzyl, E is alkyl-substituted piperidylaminocarbonyl. In another embodiment, when Y is the group of formula IV, then E is hydrogen or alkyl-substituted piperidylaminocarbonyl.

Preferred alkyl groups are ($C_1$–$C_3$)alkyl groups. A preferred ($C_1$–$C_3$)alkyl group is methyl. A preferred anion is chloride. A preferred alkylpiperidyl is ($C_1$–$C_3$)alkyl piperidyl. Preferred nucleators include those having the structures:

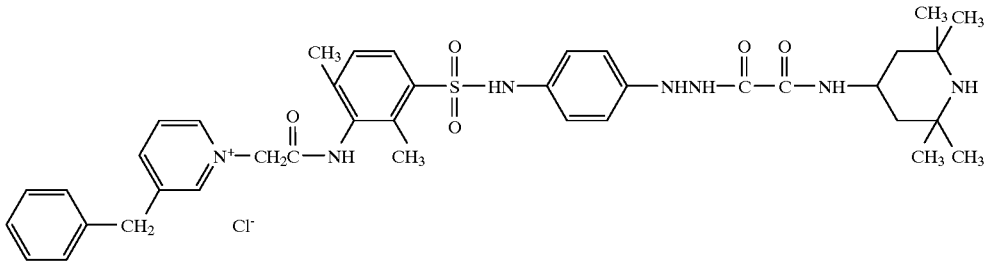

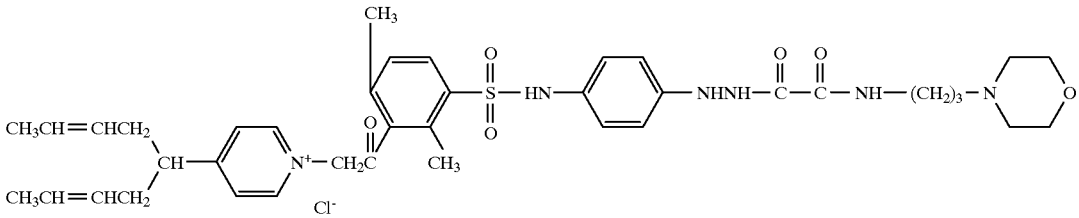

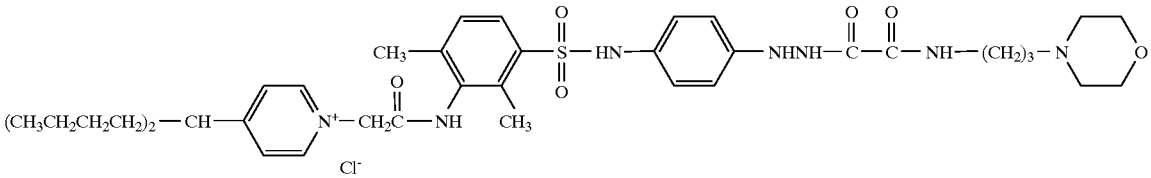

-continued

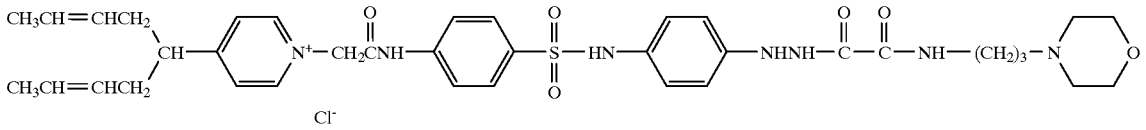

In another aspect the invention is a high contrast photographic element suitable for use as a graphics art film containing a nucleator having structure I.

In yet another aspect, the invention is an imaging process that employs photographic elements containing the nucleators of structure I.

DETAILED DESCRIPTION OF THE INVENTION

A new class of nucleators for photographic elements useful as graphic arts films has been discovered that is distinguished over others previously reported in that they increase the speed and contrast of films and improve their dot quality for halftone applications. Some of the advantages the nucleators impart to lithographic films in particular include: (i) high contrast, which provides excellent sharpness to the edge of the image; (ii) excellent dot quality, equal or better to the current state of the art; (iii) high photographic speed, suitable for halftone films. In addition, use of these nucleators eliminates the need for boosters to obtain good dot quality and photographic speed.

The nucleators are incorporated into a photographic element comprising, among other materials, a light sensitive silver halide coating or layer interposed on a substrate. The production of photographic elements is well known in the art and is described in U.S. Pat. No. 4,988,604, for example. Generally, the nucleators are applied to the substrate by incorporating them in the silver halide emulsion prior to coating the substrate. After drying the coated element, the element is ready for imagewise exposure.

The nucleator is typically present in the film composition at a concentration of from about $1\times10^{-4}$ to about $5\times10^{-3}$ moles per mole of silver, more preferably from about $2.5\times10^{-4}$ to $2.5\times10^{-3}$ moles per mole of silver, and most preferably from about $5\times10^{-4}$ to $1.5\times10^{-3}$ moles per mole of silver.

The nucleators may be used in combination with negative-working photographic emulsions comprised of radiation-sensitive silver halide grains capable of forming a surface latent image and a binder. The silver halide emulsions preferably include chlorobromide emulsions as conventionally employed in forming lithographic photographic elements, as well as silver bromide and silver bromoiodide emulsions, which are recognized in the art as being capable of attaining higher photographic speed.

Silver halide emulsions contain a binder in addition to silver halide grains. Typical binders include gelatin, acrylamide/methacrylic acid copolymers, hydroxyethyl cellulose, and polyvinyl alcohol. A preferred binder is gelatin, which can be derived from any of a number of natural sources known to those skilled in the art. The proportion of binder can be varied widely, but typically ranges from about 20 to 250 g per mole of silver.

The silver halide emulsions are spectrally sensitized, preferably from the blue to the near infrared range and more preferably in the 450 nm to 800 nm wavelength range, with dyes. The dyes may be selected from a variety of classes, including the polymethine dye class, which includes cyanines, merocyanines, complex cyanines and merocyanines (i.e., tri-, tetra- and polynuclear cyanines and merocyanines), oxonols, hemioxonols, styryls and merostyryls. Silver halide emulsions, their preparation, and the preparation of photosensitive layers therefrom, are described in: *Research Disclosure*, Item 17643, December 1978; *Research Disclosure*, Item 18431, August 1979; *Research Disclosure*, Item 22534, January, 1983; and Abbot, U.S. Pat. No. 4,425,425.

Photographic elements containing the nucleators can be coated on a variety or supports that provide dimensional stability to the photographic element. Typical photographic supports include polymer, paper, metallic sheet or foil, glass and ceramic elements. Typical of polymeric film supports are films of cellulose nitrate and cellulose esters such as cellulose triacetate and diacetate, polystyrene, polyamines, homo- and copolymers of vinyl chloride, poly(vinyl acetal), polycarbonate, homo- and copolymers of olefins, such as polyethylene and polypropylene, and polyesters of dibasic aromatic carboxylic acids with divalent alcohols, such as poly(ethylene terephthalate).

The photographic elements can be imagewise exposed with various forms of energy, ranging from the ultraviolet, visible, and infrared regions of the electromagnetic spectrum as well as electron beam and beta radiation, gamma ray, X-ray, alpha particle, neutron radiation. Either noncoherent or coherent radiation may be used. Exposures can be monochromatic, orhtochromatic or panchromatic. Imagewise exposures at ambient, elevated or reduced temperatures and/or pressures, including high or low intensity exposures, continuous or intermittent exposures, exposure times ranging from minutes to relatively short durations in the millisecond to microsecond range and solarizing exposures, can be used within the useful response ranges determined by conventional sensitometric techniques, as illustrated by T. H. James in *The Theory of the Photographic Process,* 4th Edition, MacMillan (1977).

The light-sensitive silver halide emulsion contained in the photographic elements is processed following exposure to form a visible image by associating the silver halide with an aqueous alkaline medium in the presence of a developing agent, contained either in the medium or the element. A distinct advantage of the invention is that the photographic elements can be processed in conventional developers, instead of the specialized developers conventionally employed with lithographic photographic elements, to obtain very high contrast images.

The photographic elements are preferably processed in developing compositions containing a dihydroxybenzene and more preferably a hydroquinone developing agent. It is more preferred that they are processed in a developing composition containing an auxiliary developing agent in addition to the dihydroxybenzene, which functions as the primary developing agent. Phenidone-type auxiliary developing agent such as 1-phenyl-3-pyrazolidinone, are especially preferred.

The nucleators are hydrizides having a general structure (I). The structure includes a substituted acetamido group on an arylsulfonamido radical of the parent structure. The acetamido group is either meta or para to the sulfonamide. Optionally, the acetamido is substituted with one of three charged groups: substituted pyridinium, fused ring cycloalkenylpyridinium, or substituted or unsubstituted tripheylphosphonium.

A series of compounds of corresponding to structure (I) was synthesized. Each compound was incorporated into a light-sensitive photographic emulsion, which was used to prepare film. The films were exposed and tested by sensitometry methods to determine the effectiveness of the nucleators as contrast improving agents. The evaluation was carried out by sensitometrically comparing the performance of film containing candidate nucleators with film containing nucleators known in the art and with film containing no nucleators.

Table 1 presents the structure of the comparative nucleators. Comparative compound 1 includes the five-membered pyrrolidine ring as Group A, and was reported in Okamura, U.S. Pat. No. 5,316,890. Comparative Compound 2 includes an alkyl group as A, and was reported in Looker, U.S. Pat. No. 4,994,365. Comparative Compound 3 also contains the five-membered pyrollidine ring as Group A, and is therefore similar to Comparative Compound 1 reported in U.S. Pat. No. 5,316,890, but it has the linear, para configuration. Comparative Compound 3 is similar in structure to known nucleators but is not herein specifically acknowledged to be known in the art. Comparative Compound 4 which was reported in U.S. Pat. No. 5,316,890 but has a benzyl group substituted in the 4-position of the pyridinium moiety with a cyanophenyl functionality on the hydrazino group.

TABLE 1

COMPARATIVE COMPOUND 1

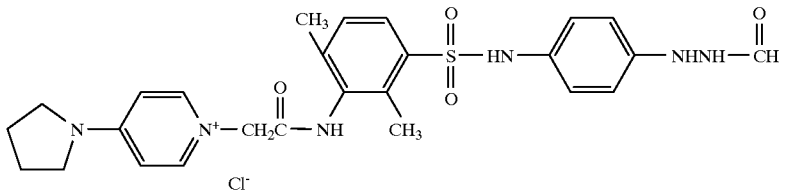

COMPARATIVE COMPOUND 2

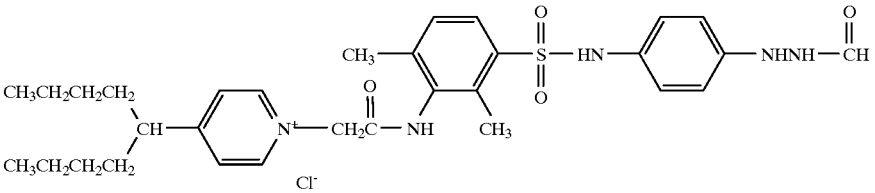

COMPARATIVE COMPOUND 3

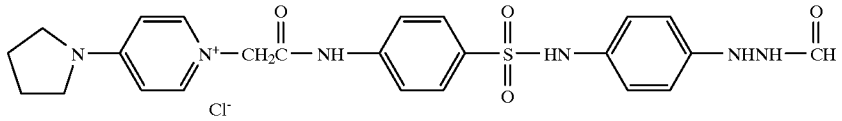

COMPARATIVE COMPOUND 4

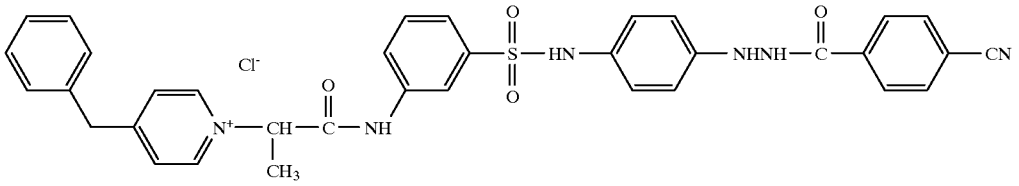

Tables 2A, 2B, and 2C present the structures of the nucleator compounds of the invention prepared and tested. These compounds are described in reference to general structure I containing the various substituent groups Z, Y, A, B, C, D and E. Table 2A presents the structures of compounds in which Y has general structure III. Table 2B presents the structures of compounds in which Y has general structure IV. Table 2C presents the structures of compounds in which Y has general structure V.

TABLE 2A

Test Compounds
Groups and Positions in Structure I where Y has the general structure III (Pyridinium)

| Compound | Z Position[1] | Substitutent Groups A | B | C | D | E |
|---|---|---|---|---|---|---|
| Without Nucleator | | | | | | |
| Compara. 1 | Meta | (a) | H | $CH_3$ | $CH_3$ | H |
| Compara. 2 | Meta | (b) | H | $CH_3$ | $CH_3$ | H |
| 1 | Meta | (c) | H | $CH_3$ | $CH_3$ | H |
| 2 | Meta | (c) | H | $CH_3$ | $CH_3$ | (d) |
| 3 | Meta | (c) | H | $CH_3$ | $CH_3$ | (e) |
| 4 | Meta | (c) | H | $CH_3$ | $CH_3$ | (f) |
| 5 | Meta | (c) | H | H | H | H |
| 6 | Meta | (c) | H | H | H | (d) |
| 7 | Meta | (c) | H | H | H | (e) |
| 8 | Meta | (c) | H | H | H | (f) |
| 9 | Para | (c) | H | — | H | H |
| 10 | Para | (c) | H | — | H | (e) |
| 11 | Para | (c) | H | — | H | (d) |
| 12 | Para | (c) | H | — | H | (f) |
| Compara. 3 | Para | (a) | H | — | H | H |
| 13 | Para | (g) | H | — | H | (f) |
| 14 | Para | (h) | H | — | H | (f) |
| 15 | Meta | (g) | H | $CH_3$ | $CH_3$ | (f) |
| 16 | Meta | (h) | H | $CH_3$ | $CH_3$ | (f) |
| 17 | Meta | H | (i) | $CH_3$ | $CH_3$ | H |
| 18 | Meta | H | (i) | $CH_3$ | $CH_3$ | (d) |
| 19 | Meta | H | (i) | $CH_3$ | $CH_3$ | (e) |
| 20 | Meta | H | (i) | $CH_3$ | $CH_3$ | (f) |
| 21 | Meta | (k) | H | $CH_3$ | $CH_3$ | H |
| 22 | Meta | (k) | H | $CH_3$ | $CH_3$ | (d) |
| 23 | Meta | (k) | H | $CH_3$ | $CH_3$ | (e) |
| 24 | Meta | H | (i) | $CH_3$ | $CH_3$ | (l) |
| 25 | Meta | H | (i) | $CH_3$ | $CH_3$ | (j) |
| 26 | Meta | (c) | H | $CH_3$ | $CH_3$ | (j) |
| 27 | Meta | (g) | H | $CH_3$ | $CH_3$ | (j) |
| 28 | Meta | (b) | H | $CH_3$ | $CH_3$ | (f) |

[1]Position of the "Z group" relative to the sulfonyl group;
(a) = 1-pyrrolidinyl;
(b) = 5-nonyl,
(c) = 4-methyl-1-piperidinyl;
(d) = ethoxycarbonyl;
(e) = 2,2,6,6-tetramethyl-1-piperidylaminocarbonyl;
(f) = 3-morpholinopropylaminocarbonyl;
(g) = 3-cyclohexenyl;
(h) = 2,7-nonadiene-5-yl;
(i) = benzyl;
(j) = 2-morpholinoethylaminocarbonyl;
(k) = n-propylphenyl,
(l) = N-morpholinoaminocarbonyl.

TABLE 2B

Test Compounds
Groups and Positions in Structure I where Y has general structure IV (2,3-cycxoheptenopyridinium-1)

| Compound | Position[1] | Substituent Groups C | D | E |
|---|---|---|---|---|
| 29 | Meta | $CH_3$ | $CH_3$ | H |
| 30 | Meta | $CH_3$ | $CH_3$ | (e) |

[1]Position of the "Z group" relative to the sulfonyl group;
(e) 2,2,6,6-tetramethyl-1-piperidylaminocarbonyl.

TABLE 2C

Test Compounds
Groups and Positions in Generalized Structure I where Y has a general structure V (Phoshonium)

| Compound | Position[1] | Substituent Groups C | D | E |
|---|---|---|---|---|
| 31 | Meta | $CH_3$ | $CH_3$ | (f) |
| 32 | Meta | $CH_3$ | $CH_3$ | (j) |
| 33 | Meta | $CH_3$ | $CH_3$ | (l) |

[1]Position of the "Z group" relative to the sulfonyl group;
(f) = 3-morpholinopropylaminocarbonyl;
(j) = 2-morpholinoethylaminocarbonyl;
(l) = N-morpholinoaminocarbonyl.

Table 3 presents the sensitometric data obtained from exposed films containing the materials described in Tables 1, 2A, 2B and 2C, including film containing no nucleator, film containing comparative nucleators, and film containing nucleators of the invention.

TABLE 3

SENSITOMETRY

| Compound Tested | Speed (a) | G1 (b) | G2 (b) | G3 (b) | B + F (c) | Dot (d) |
|---|---|---|---|---|---|---|
| Without Nucleator | 172 | 2.3 | 9.1 | 11.8 | 0.04 | 5 |
| Compara. 1 | 480 | 7.7 | 24.6 | 16.4 | 0.06 | 3 |
| Compara. 2 | 226 | 7.7 | 22.7 | 13.0 | 0.04 | 2 |
| 1 | 383 | 15.8 | 35.2 | 25.4 | 0.03 | 2 |
| 2 | 238 | 9.5 | 28.5 | 18.3 | 0.03 | 2 |
| 3 | 271 | 12.1 | 35.8 | 23.2 | 0.03 | 2 |
| 4 | 290 | 12.6 | 43.7 | 35.8 | 0.04 | 2 |
| 5 | 278 | 14.8 | 28.5 | 10.1 | 0.04 | 2 |
| 6 | 137 | 7.7 | 32.3 | 10.9 | 0.04 | 1 |
| 7 | 268 | 9.5 | 35.8 | 16.1 | 0.04 | 1 |
| 8 | 125 | 7.0 | 27.0 | 8.3 | 0.04 | 1 |
| 9 | 200 | 6.2 | 40.2 | 9.3 | 0.03 | 1 |
| 10 | 247 | 10.2 | 31.3 | 13.8 | 0.03 | 1 |
| 11 | 186 | 10.9 | 30.8 | 16.1 | 0.03 | 1 |
| 12 | 198 | 6.2 | 37.1 | 37.5 | 0.04 | 1 |
| Compara. 3 | 478 | 7.2 | 21.4 | 15.4 | 0.05 | 3 |
| 13 | 286 | 9.5 | 41.0 | 21.3 | 0.04 | 3 |
| 14 | 174 | 7.3 | 44.7 | 78.7 | 0.04 | 1 |
| 15 | 322 | 13.1 | 38.6 | 20.2 | 0.05 | 1 |
| 16 | 222 | 9.8 | 37.1 | 52.5 | 0.04 | 1 |
| 17 | 338 | 7.2 | 34.5 | 27.2 | 0.03 | 1 |
| 18 | 250 | 9.8 | 35.2 | 32.8 | 0.04 | 1 |
| 19 | 279 | 14.3 | 38.6 | 21.9 | 0.04 | 1 |
| 20 | 189 | 8.3 | 54.7 | 71.6 | 0.04 | 2 |
| 21 | 167 | 17.3 | 27.0 | 11.6 | 0.04 | 1 |
| 22 | 141 | 6.4 | 26.6 | 12.5 | 0.04 | 1 |
| 23 | 187 | 10.5 | 37.1 | 25.4 | 0.04 | 1 |
| 24 | 175 | 9.0 | 56.2 | 14.6 | 0.04 | 2 |
| 25 | 183 | 12.6 | 45.8 | 14.1 | 0.05 | 1 |
| 26 | 167 | 7.3 | 37.9 | 29.2 | 0.04 | 1 |
| 27 | 181 | 10.5 | 44.7 | 34.2 | 0.04 | 1 |
| 28 | 196 | 8.8 | 51.8 | 56.2 | 0.04 | 1 |
| 29 | 266 | 9.5 | 27.7 | 25.4 | 0.04 | 2 |
| 30 | 232 | 6.6 | 37.9 | 11.6 | 0.04 | 1 |
| 31 | 187 | 11.7 | 39.4 | 17.5 | 0.04 | 1 |
| 32 | 175 | 10.5 | 38.6 | 13.8 | 0.04 | 1 |
| 33 | 198 | 5.3 | 30.3 | 17.9 | 0.04 | 2 |

(a) Speed at 0.5 Density above base plus fog expressed arithmetically as the anti-logarithm of the relative Log Exposure;
(b) Gradients are measured from the following Density points (above base plus fog): G1 = 0.1–0.5 Density; G2 = 0.5–3.0 Density; G3 = 3.0–4.0 Density;
(c) Base plus fog density;
(d) expressed on a scale from 1 = Excellent, hard lith-type, to 5 = Poor, rapid-access type fuzzy dots.

The preferred nucleators, i.e., those showing superior results depicted in Table 3, are:

Compound 19
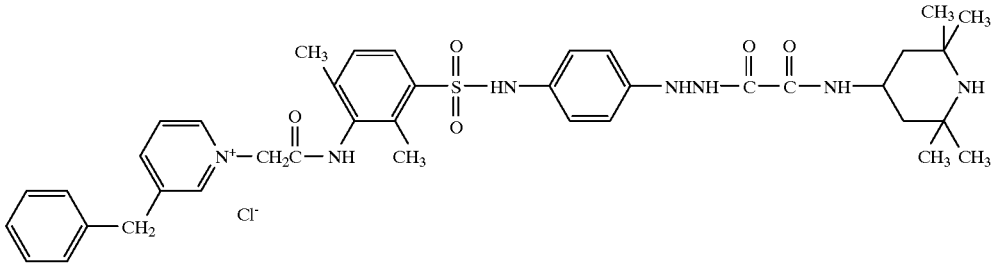
Compound 16
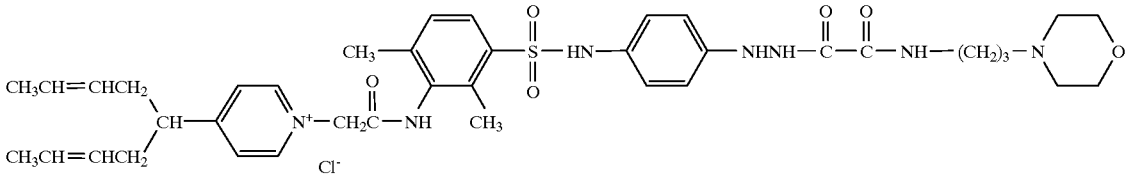
Compound 15
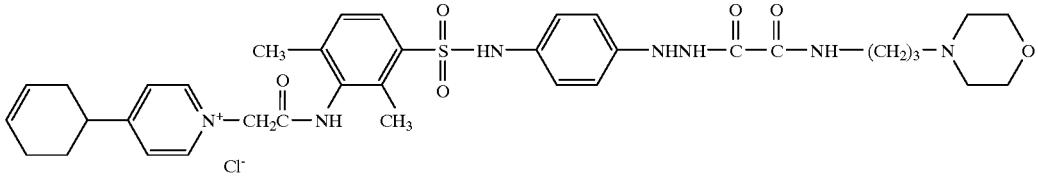
Compound 28
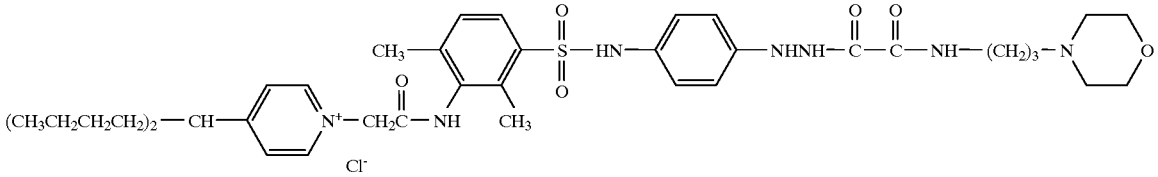
Compound 14
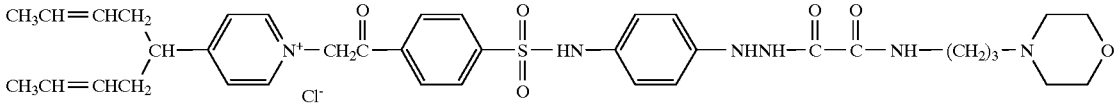
Compound 25
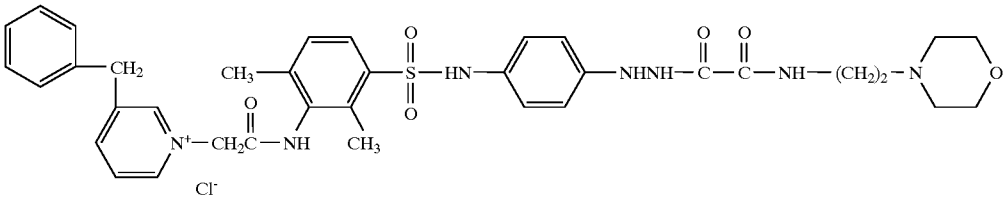
Compound 30
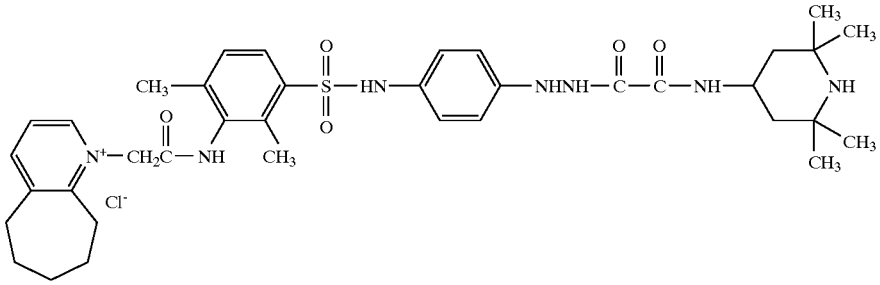

-continued

Compound 31

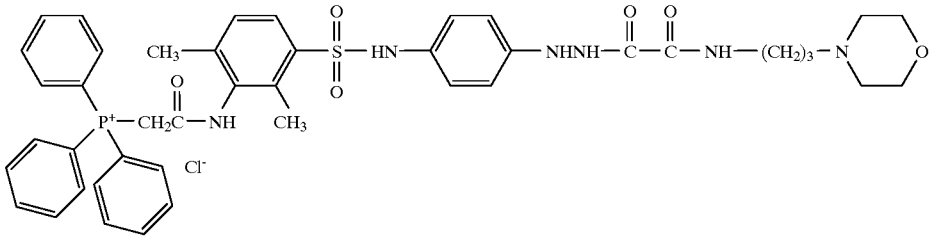

Compound 32

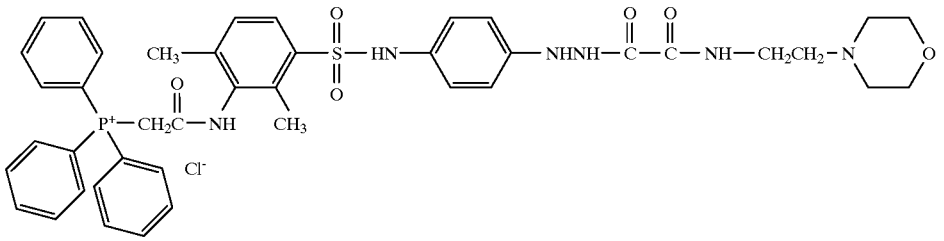

Preferred substituents on the pyridinium moiety (III) include alkenyl, alkadienyl, cycloalkenyl and more particularly include vinyl, 1-propenyl, allyl, isopropenyl, 2-butenyl, isobutenyl, 3-pentenyl, hexenyl, octenyl, divinylmethyl, diallylmethyl, 1,5-hexadien-3-yl, 2,5-heptadien-4-yl, 2,6-octadien-4-yl, 2,7-nonadien-5-yl. The most preferred is $C_2$–$C_{18}$ alkadienyl such as 2,7-nonadien-5-yl. Cycloalkenyl includes cyclohexenyl and cyclopentenyl, particularly 3-(cyclohexen-1-yl). Useful pyridinium moieties having nitrogen heterocycle radical substituents include piperidyl and methyl, ethyl or propylpiperidyl.

The triphenylphosphonium group (V) may bear ortho, meta, or para substituent groups on one or more of the phenyl groups, selected from alkyl, alkenyl, cycloalkyl, cycloalkenyl, alkoxy, halogen and carboxyalkyl; preferred are methyl and methoxy.

Substituted or unsubstituted carbamoyls (substituent E) include the structure:

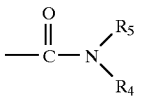

wherein $R_4$ and $R_5$, alike or different, are selected from the group consisting of hydrogen, alkyl, alkenyl, aryl, pyrrolidyl and piperidyl, morpholino and morpholinoalkyl including 2-morpholinoethyl and 3-morpholinopropyl.

A preferred piperidyl substituent is 2,2,6,6-tetramethyl-4-piperidyl, having the structure:

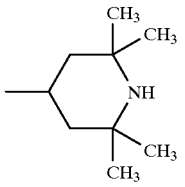

EXAMPLES

Example 1

Example 1 describes in detail the methods used to prepare the emulsions and the photographic element incorporating the novel nucleators, comparative nucleators or, in one case, no nucleator. All of the nucleators described in Tables 2A, 2B, and 2C or presented structurally immediately herein were incorporated in test films according to this methodology. The test photographic elements were then image-wise exposed and sensitometrically evaluated as reported in Table 3.

An 80:20 mole percent chloro-bromide emulsion having cubic crystals of 0.25 micron edge length was prepared by an ammoniacal method using a balanced double jet precipitation of one mole of 1.2 normal silver nitrate and a 1.55 mole mixture of potassium bromide-ammonium chloride with 2.2 g/mole of ethylenediamine and 335 nanomoles/mole of sodium hexachlororhodate into a 3.6 weight percent gel solution at pH 8 over a 15 min period at 35° C. The soluble by-product salts were removed by washing with water after coagulating the emulsion with an aromatic sulfonate at low pH. The emulsion was then redispersed to a 6 percent silver analysis with 50 g of gelatin, and was digested at 50° C. for 42 min at pH 6 in the presence of 0.05 mole potassium iodide, 7 mg sodium benzenethiosulfinate, 11 micromoles sodium tetrachloroaurate, and 31 micromoles of sodium thiosulfate.

The emulsion was stabilized with 4500 micromoles of 4-hydroxy-6-methyl-1,3,3a,7-tetraazaindene and spectrally sensitized with 5-[(3-ethyl-2-thiazolidine)-ethylidene]-4-oxo-2-thioxo-3-thiazolidine acetic acid. Sodium dioctylsulfosuccinate was added as a coating aid at 0.7 g per mole of silver, a latex for dimensional stability, and the Comparative and Test Compounds were added as methanol solutions at the level of $1\times10^{-3}$ mole per mole of silver.

The emulsions were then coated onto a polyester base at a coating weight of 40 mg silver per square decimeter, and were overcoated with an aqueous anti-abrasion layer containing dimethylolurea as a hardening agent. The dried photographic element samples were then oven aged for 24 hr at 120° F. and 20% relative humidity to simulate results expected from natural aging.

The sensitometric data presented in Table 3 were obtained after film exposure by a tungsten point source, followed by developing in a developer whose composition is listed in Table 4, and fixing with a fixer solution described in Table 5.

TABLE 4

| Developer Composition | |
|---|---|
| Ingredient | Amount |
| Potassium Hydroxide, 45% | 68.66 |
| Versenol-120 | 5.33 |
| Diethanolamine, 85% | 14.00 |
| Diethylene Glycol | 10.66 |
| Potassium Metasulfite | 45.33 |
| Potassium Carbonate, Anh | 20.66 |
| Potassium Bromide | 5.00 |
| Dimezone-S | 0.67 |
| Hydroquinone | 24.66 |
| Sodium Erythorbate | 2.66 |
| PMT | 0.097 |
| Benzotriazole | 0.20 |
| 2-Mercaptobenzothiazole | 0.053 |
| Water | to 1.0 Liter |
| pH | 10.8 |

TABLE 5

| Fixer Composition | |
|---|---|
| Ingredient | Amount |
| Ammonium Thiosulfate, 60% | 276.20 |
| Sodium Acetate, Anh | 21.20 |
| Sodium Metabisulfite | 9.05 |
| Acetic acid, Glacial | 8.38 |
| Citric Acid | 3.28 |
| Water | to 1.0 Liter |
| pH | 4.8 |

All of the ingredients of Tables 4 and 5 are in terms of g/L of working strength solution and processing conditions were 30 sec and 38° C.

INTERMEDIATE AND TEST COMPOUND PREPARATION

The nucleators in Tables 2A–2C were prepared by methods generally known to one skilled in the art of synthetic organic chemistry. Most of the compounds were prepared by coupling groups A through E to hydrazine intermediates known the art. Table 6 summarizes the structure and source of intermediate compounds or precursors of the active nucleators and includes the general structure of intermediates 4, 8, 12, 13 and 14.

TABLE 6

Intermediates

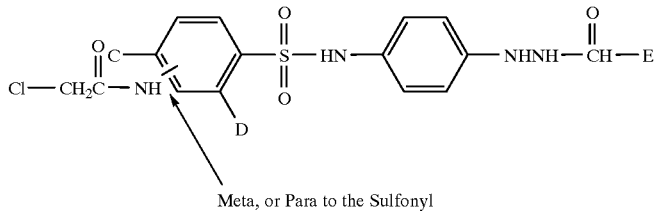

| Intermed. Cpd | Position[1] | C | D | E | Reference |
|---|---|---|---|---|---|
| 1 | meta | $CH_3$ | $CH_3$ | H | U.S. Pat. No. 4,994,365 |
| 2 | meta | $CH_3$ | $CH_3$ | (d) | U.S. Pat. No. 4,994,365 |
| 3 | meta | $CH_3$ | $CH_3$ | (e) | U.S. Pat. No. 5,451,486 |
| 4 | meta | $CH_3$ | $CH_3$ | (f) | see Example 2 |
| 5 | meta | H | H | H | see Example 3 |
| 6 | meta | H | H | (d) | U.S. Pat. No. 4,988,603 |
| 7 | meta | H | H | (e) | U.S. Pat. No. 5,229,248 |
| 8 | meta | H | H | (f) | see Example 3 |
| 9 | para | — | H | H | see Example 4 |
| 10 | para | — | H | (d) | intermed. 9 |
| 11 | para | — | H | (e) | intermed. 9 |
| 12 | para | — | H | (f) | see Example 4 |
| 13 | meta | $CH_3$ | $CH_3$ | (j) | see Example 5 |
| 14 | meta | $CH_3$ | $CH_3$ | (l) | see Example 5 |

[1]Position of the "Z group" relative to the sulfonyl group; (d) = ethoxycarbonyl; (e) = 2,2,6,6-tetramethyl-1-piperidyaminocarbonyl; (f) = 3-morpholinopropylaminocarbonyl; (j) = 2-morpholinoethylaminocarbonyl; (l) = N-morpholinoaminocarbonyl.

PREPARATION OF INTERMEDIATES

Example 2

Preparation of Intermediate 4

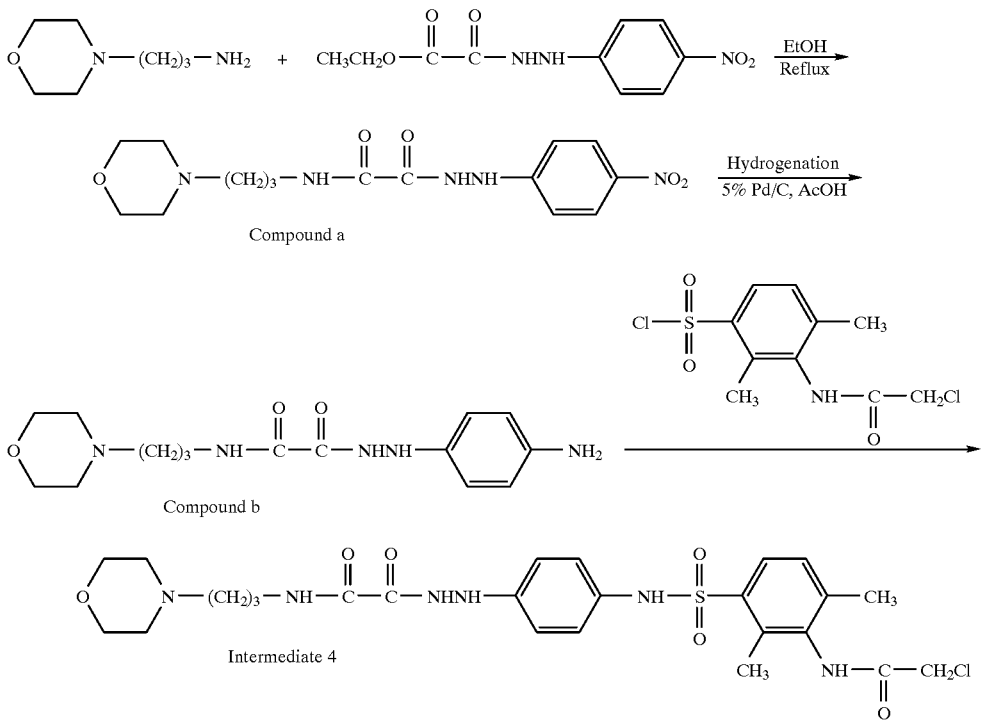

Compound a was prepared as follows: A mixture of 70 g (0.276 mole) of ethoxalyl-2-[nitrophenyl]hydrazine (U.S. Pat. No. 4,686,167) and 50 g (0.347 mole) of 4-[3-aminopropyl]-morpholine in 480 mL of anhydrous ethanol was refluxed for 18 to 20 hr with stirring. After the reaction mixture cooled to room temperature, the solid that separated was filtered and washed with ethanol. It was finally stirred in hot acetonitrile, filtered, washed several times with petroleum ether and dried. Yield: 84 g (86%). mp: 188–190° C., Analysis, Calcd. for $C_{15}H_{21}N_5O_5$: C=51.28; H=6.03; N=19.93; Found: C=51.45; H=6.05; N=19.77.

Compound b was prepared as follows: Compound a (25 g) in 220 mL of acetic acid was catalytically reduced using 0.6 g of 5% Pd/C at 20 psi. After the theoretical amount of hydrogen was absorbed, the reaction mixture was filtered and the filtrate evaporated on a rotary evaporator. The residue was diluted with ethanol and evaporated. It was finally dissolved in ethanol/methanol and diluted with iso-propyl ether. The solid so obtained was filtered, washed several times with iso-propyl ether, and finally with petroleum ether. The solid was stirred in hot methanol, filtered, and vacuum dried. Yield: 18.8 g (82%). mp: 181–183° C.; Analysis, Calcd. for $C_{15}H_{23}N_5O_3$: C=56.06; H=7.21; N=21.79; Found: C=55.98; H=7.04; N=21.47.

Intermediate 4 was then prepared as follows: A mixture of 11 g (0.0342 mole) of Compound b and 5.53 g (0.0428 mole) of N,N-diisopropylethylamine in 30 mL of N,N-dimethylacetamide was cooled to −5° C. A solution of 10.34 g (0.035 mole) of 3-(chloroacetamido)-2,4-(dimethyl) benzenesulfonyl chloride in 20 mL of N,N-dimethylacetamide was added dropwise at −5 to 0° C. The reaction mixture was allowed to come to room temperature and was stirred at room temperature for 48 hr. The mixture was then poured into about 1 L of ice water, and the solid was filtered and washed with water. The crude compound was dissolved in methanol, charcoal treated, and filtered. The filtrate was poured into an excess of iso-propyl ether, and the solid was filtered, washed with iso-propyl ether, and finally with ether to afford Intermediate 4 in 60% yield (11.94 g); mp 240–242° C.

Example 3

Preparation of Intermediate 8

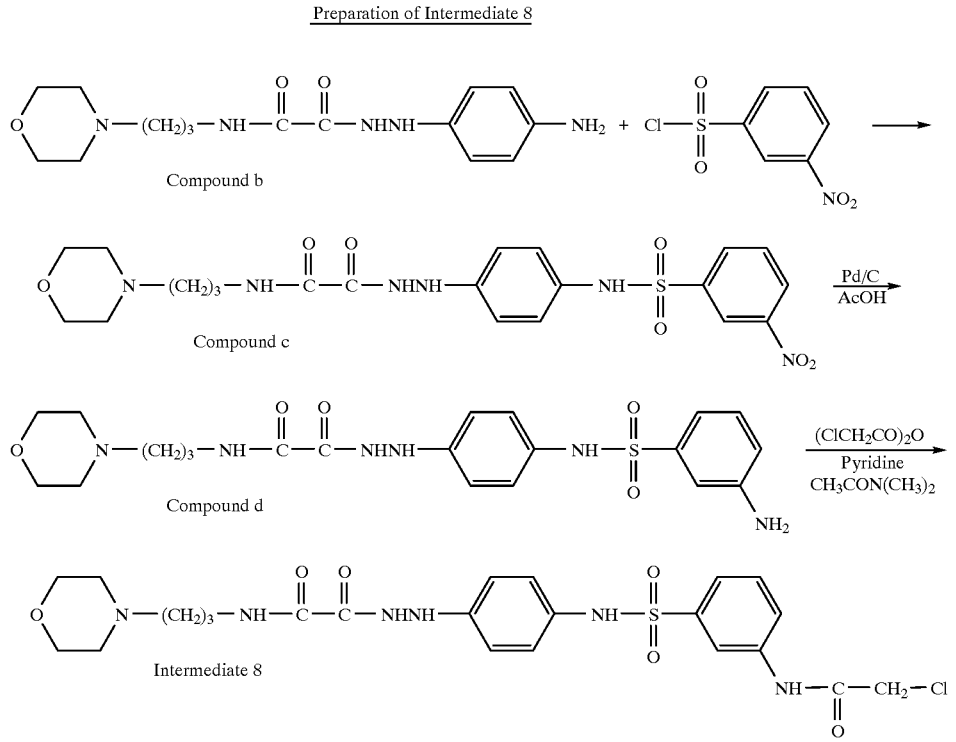

The synthetic scheme for Intermediate 8 is as follows: A mixture of 16.07 g of Compound b, 5.04 g of triethylamine, and 0.4 g of 4-dimethyl-aminopyridine in 40 mL of anhydrous N,N-dimethylacetamide was cooled to −10° C. A solution of 11.10 g of 3-nitrobenzenesulfonyl chloride in 35 mL of acetonitrile was then added dropwise in such a way that the temperature was maintained between −10 and −5° C. After addition, the reaction mixture was stirred overnight at room temperature and poured into ice-water. The solid that separated was filtered, washed with water, and dissolved in about 400 mL of ethyl acetate. The ethyl acetate was washed twice with water, and finally with brine. After drying over magnesium sulfate, the solvent was evaporated on a rotary evaporator to a small volume, and poured into iso-propyl ether. The resulting Compound c was filtered, washed with petroleum ether, and dried. Yield: 12.2 g (48%). mp 135–137° C.

A solution of 12 g of the nitro Compound c in 140 mL of acetic acid was subjected to catalytic hydrogenation using 0.6 g of 5% Pd/C at 40 psi. After the theoretical amount of hydrogen was absorbed, the catalyst was filtered off, and the filtrate was evaporated on a rotary evaporator. The residue was dissolved in ethanol and evaporated again. It was then triturated with iso-propyl ether, filtered, and finally crystallized from ethanol/methanol. Yield of Compound d: 5.83 g (52%); mp 130–132° C. Analysis: Calcd. for $C_{21}H_{28}N_6O_5S$-$0.5CH_3OH$: C=52.43; H=6.10; N=17.06; S=6.51. Found: C=52.74; H=5.80; N=16.80; S=6.75.

Intermediate 8 was then prepared as follows: A mixture of 7.63 g of Compound d and 1.33 g of anhydrous pyridine in 10 mL of anhydrous N,N-dimethylacetamide was cooled to −5° C. A solution of 2.88 g of chloroacetic anhydride in 4 mL of N,N-dimethylacetamide was added dropwise while the temperature was maintained between −5 and 0° C. The reaction mixture was then stirred at room temperature for 5 hr and then poured into cold water containing some sodium carbonate. After stirring for a few minutes, the solid was filtered, washed with water, and air-dried. It was finally crystallized from N,N-dimethylacetamide/t-butyl methyl ether. The crystallized solid was filtered, washed with t-butyl methyl ether, and dried under vacuum to afford Intermediate 8. Yield: 4 g (45%). mp 223–225° C.

Example 4

Preparation of Intermediate 12

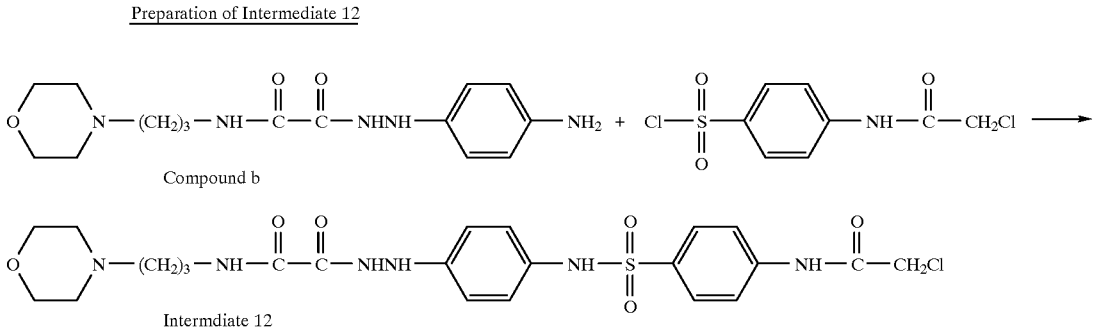

Intermediate 12 was prepared as follows: A mixture of 15.0 g of Compound b and 6.03 g of N,N-diisopropylethylamine in 40 mL of N,N-dimethylacetamide was cooled to −5° C. A solution of 13.14 g of 4-[(chloroacetyl)amino]-benzenesulfonyl chloride, *J. Chem. Soc.,* 8, 409(1986), in 30 mL of N,N-dimethylacetamide was added dropwise while the temperature was maintained between −5 and 0° C. The reaction mixture was stirred at room temperature overnight, and then poured into cold water. The solid that separated was filtered, washed with water, and the crude product was crystallized from a mixture of N,N-dimethylacetamide and methanol. The pure Intermediate 12 was isolated by addition of t-butyl methyl ether. Yield: 18 g (70%). mp 262–264° C. Analysis: Calcd. for $C_{23}H_{29}ClN_6O_6S$-0.5$CH_3OH$: C=49.60; H=5.49;

N=14.77; Cl=6.23; S=5.63. Found: C=49.79; H=5.42; N=14.51; Cl=6.60; S=5.87.

Example 5

Preparation of Intermediates 13 and 14

Intermediates 13 and 14 were prepared as described for Example 4 but using 4-(2-aminoethyl)morpholine or 4-aminomorpholine rather than 4-(3-aminopropyl) morpholine as used in Example 4.

Preparation of Compounds

The Compounds were prepared by the following methods. In each case, the recovered test compound was analyzed for elemental carbon, hydrogen and nitrogen content, plus sulfur and chlorine, where appropriate. The results of elemental analysis agreed with the calculated values for all the formulae derived from the postulated molecular structures synthesized as test compounds.

Example 6

Compound 1

A mixture of 2.05 g (0.005 mole) of Intermediate 1 and 1.54 g (0.0088 mole) of 4-[4-methylpiperidino]pyridine in 6 mL of N,N-dimethylacetamide was heated on a steam bath for 1.25 hr. After cooling to room temperature, the reaction mixture was poured into 100 mL of methyl ethyl ketone and the solid that separated out was filtered, washed with petroleum ether, and crystallized from methanol/t-butyl methyl ether. Yield: 2.81 g (95%). mp softens at 200° C., bubbling at 250° C.

The following compounds (2–33) were prepared using the general procedure described in Example 6.

Example 7

Compound 2

Reaction of 2.41 g of Intermediate 2 (0.005 mole) with 1.54 g (0.0088 mole) of 4-[(4-methylpiperidino]pyridine gave Test Compound 2. Yield: 2.45 g (75%). mp: softens at 215° C., bubbling at 240° C.

Example 8

Compound 3

Compound 3 was obtained from 2.96 g of Intermediate 3 and 1.54 g of 4-[4-methylpiperidino]pyridine. Yield: 3.45 g (90%). mp: greater than 250° C.

Example 9

Compound 4

Reaction of Intermediate 4 with 4[4-methylpiperidino] pyridine afforded Compound 4. Yield: 81%. mp 220–223° C.

Example 10

Compound 5

Intermediate 5, 1.42 g (0.0037 mole) on reaction with 1.32 g (0.0075 mole) of 4-[4-methylpiperidino]pyridine gave Compound 5. Yield: 1.95 g (94%). mp 230–233° C.

Example 11

Compound 6

Prepared from Intermediate 6 by reaction with 4-(4-methylpiperidino)pyridine.

Example 12

Compound 7

A mixture of 1.40 g (0.00248 mole) of Intermediate 7 and 0.83 g (0.00471 mole) of 4-[4-methylpiperidino]pyridine in 6 mL of N,N-dimethylacetamide was heated to 95–100° C. for 1 hr. Working-up the reaction mixture as described in the general procedure (Example 6) gave Compound 7. Yield: 0.6 g (33%); mp bubbling at 244–246° C.; decomposes at 255° C.

Example 13

Compound 8

Prepared from Intermediate 8 by reaction with 4-(4-methylpiperidino)pyridine.

Example 14

Compound 9

Prepared from Intermediate 9 and 4-[4-methylpiperidino] pyridine by analogy to the other preparations. Yield: 71%; mp: 193–196° C.

Example 15

Compound 10

Prepared from Intermediate 11 by reaction with 4-(4-methylpiperidino)pyridine.

Example 16

Compound 11

Prepared from Intermediate 10 by reaction with 4-(4-methylpiperidino)pyridine.

Example 17

Compound 12

Prepared from Intermediate 12 by reaction with 4-(4-methylpiperidino)pyridine.

Example 18

Compound 13

Prepared from Intermediate 12 by reaction with 4-(3-cyclohexen-1-yl)pyridine.

Example 19

Compound 14

Prepared from Intermediate 12 by reaction with 5-(4-pyridyl)-2,7-nonadiene.

Example 20

Compound 15

Prepared from Intermediate 4 by reaction with 4-(3-cyclohexen-1-yl)pyridine.

Example 21

Compound 16

Prepared from Intermediate 4 by reaction with 5-(4-pyridyl)-2,7-nonadiene.

Example 22

Compound 17

Prepared from Intermediate 1 by reaction with 3-benzylpyridine.

Example 23

Compound 18

Prepared from Intermediate 2 by reaction with 3-benzylpyridine.

Example 24

Compound 19

Prepared from Intermediate 3 by reaction with 3-benzylpyridine.

Example 25

Compound 20

Prepared from Intermediate 4 by reaction with 3-benzylpyridine.

Example 26

Compound 21

Prepared from Intermediate 1 by reaction with 4-(3-phenylpropyl)pyridine.

Example 27

Compound 22

Prepared from Intermediate 2 by reaction with 4-(3-phenylpropyl)pyridine.

Example 28

Compound 23

Prepared from Intermediate 3 by reaction with 4-(3-phenylpropyl)pyridine.

Example 29

Compound 24

Prepared from Intermediate 14 by reaction with 3-benzylpyridine.

Example 30

Compound 25

Prepared from Intermediate 13 by reaction with 3-benzylpyridine.

Example 31

Compound 26

Prepared from Intermediate 13 by reaction with 4-(4-methylpiperidino)pyridine.

Example 32

Compound 27

Prepared from Intermediate 13 by reaction with 4-(3-cyclohexen-1-yl)pyridine.

Example 33

Compound 28

A mixture of 5.0 g of Intermediate 4 and 4.50 g of 4-(1-butylpentyl)pyridine in 15 mL of N,N-dimethylacetamide was heated on a steam bath for 1.5 hr. After cooling to room temperature, the reaction mixture was poured into excess of methyl ethyl ketone and the solid so obtained was filtered and washed with some iso-propyl ether. It was purified by dissolving in methanol and pouring into excess of iso-propyl ether. Yield=5.7 g (84%). mp 218–220° C.

Example 34

Compound 29

Compound 29 was prepared by heating a mixture of 2.20 g of Intermediate 1 with 1.42 g of 2,3-cycloheptenopyridine in 6 mL of N,N-dimethylacetamide in a steam bath for 3 hr. The product was isolated by pouring into excess of methyl ethyl ketone. Repeated crystallization of the crude product from methanol/iso-propyl ether gave the final compound in 90% yield (2.67 g); mp 205–210° C. with softening at 180° C.

Example 35

Compound 30

Compound 30 was similarly obtained from 2.50 g of Intermediate 3 and 1.24 g of 2,3-cycloheptenopyridine in 93% yield (2.90 g). mp 250–255° C. with softening at 235° C.

Example 36

Compound 31

Compound 31 was prepared by heating a mixture of 1.56 g of Intermediate 4 and 1.76 g of triphenylphosphine in 7 mL of N,N-dimethyl-acetamide on a steam bath for 1.5 hr. The product was isolated by pouring the reaction mixture into excess of iso-propyl ether. The triphenylphosphonium salt was stirred in fresh iso-propyl ether and filtered. It was finally purified by dissolving in methanol and diluting with iso-propyl ether. Yield: 81% (1.83 g). mp 209–214° C.

Example 37

Compound 32

Prepared from Intermediate 13 by reaction with triphenylphosphine.

Example 38

Compound 33

Prepared from Intermediate 14 by reaction with triphenylphosphine.

Having described the invention, we now claim the following and its equivalents.

What is claimed is:

1. A nucleating agent for photographic film, the nucleating agent having the structure:

I

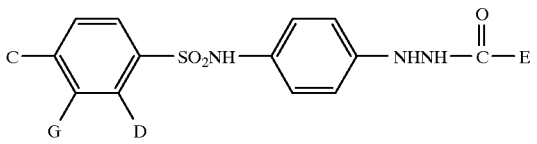

wherein:

C is hydrogen, $C_1$–$C_3$ alkyl, or Z;

D is hydrogen or $C_1$–$C_3$ alkyl;

G is hydrogen or Z;

E is selected from hydrogen, morpholino($C_1$–$C_3$) alkylaminocarbonyl, morpholinoaminocarbonyl, and alkyl-substituted piperidylaminocarbonyl;

Z has the general structure:

II

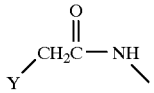

Y has the general structure:

III

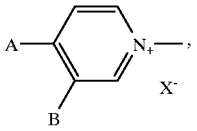

IV

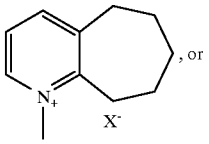

V

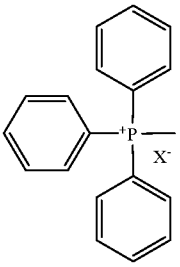

wherein:

A is selected from hydrogen, alkyl, cycloalkenyl, piperidyl, alkylpiperidyl, arylalkyl and $C_4$–$C_{12}$ alkadienyl;

B is selected from hydrogen, unsubstituted benzyl, unsubstituted alkyl, alkoxy substituted benzyl, and halogen substituted benzyl; and X is an inorganic or organic anion; with the provisos that:

A and B are not both hydrogen;

when C is Z, then D and G are hydrogen; and when G is Z, then C is either hydrogen or $C_1$–$C_3$ alkyl;

when E is hydrogen and G is Z, then A is hydrogen, piperidyl, or alkylpiperidyl.

2. The agent of claim 1 in which A is a cycloalkenyl.

3. The agent of claim 2 in which the cycloalkenyl is 3-cyclohexen-1-yl.

4. The agent of claim 1 in which A is a $C_4$–$C_{12}$ alkadienyl.

5. The agent of claim 4 in which the $C_4$–$C_{12}$ alkadienyl is 2,7-nonadien-5-yl.

6. The agent of claim 1 in which A is an arylalkyl.

7. The agent of claim 6 in which the arylalkyl is phenylpropyl.

8. The agent of claim 1 in which A is a piperidyl.

9. The agent of claim 8 in which the piperidyl is 4-methylpiperidyl.

10. The agent of claim 1 in which B is selected from the group consisting of ortho or para monosubstituted methyl, ethyl, propyl, methoxy, ethoxy and chloro benzyl.

11. The agent of claim 1 in which said C and D are methyl.

12. The agent of claim 1 in which E is selected from the group consisting of 4-morpholinoaminocarbonyl, 4-morpholinopropylaminocarbonyl, 4- morpholinoethylaminocarbonyl and 2,2,6,6-tetramethylpiperidylaminocarbonyl.

13. The agent of claim 1 in which Y is:

V

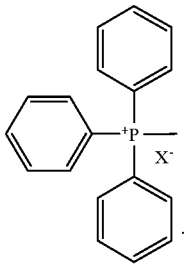

14. The agent of claim 1 in which Y is a 2,3-cycloheptenopyridinium group.

15. The agent of claim 1 having the structure:

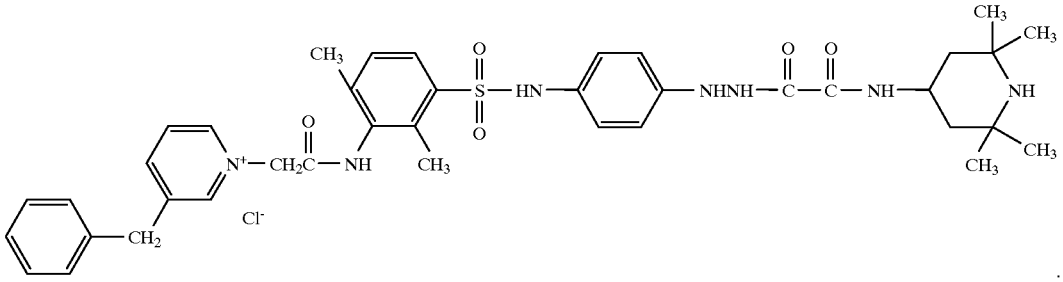

16. The agent of claim 1 having the structure:

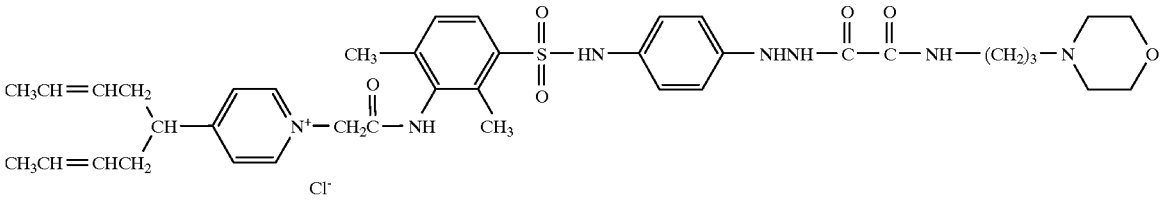

17. The agent of claim 1 having the structure:

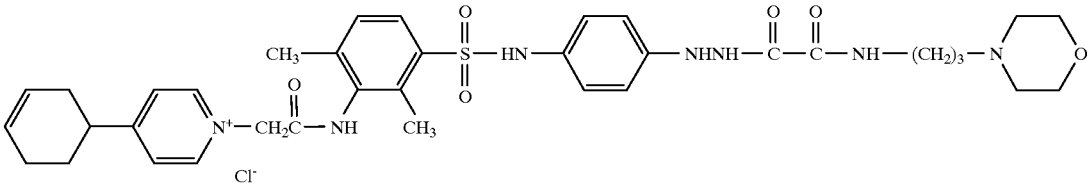

18. The agent of claim 1 having the structure:

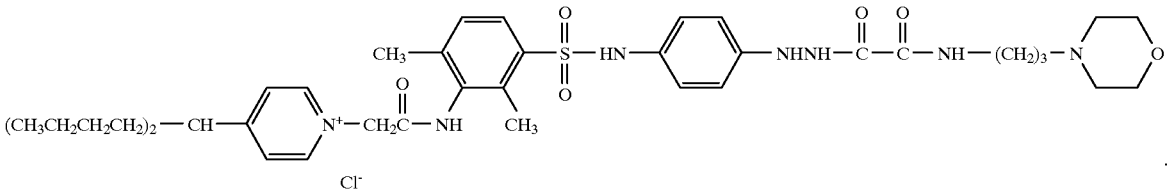
19. The agent of claim 1 having the structure:
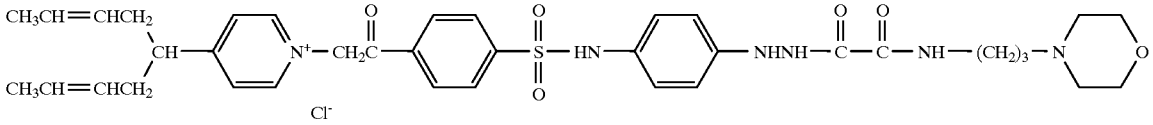
20. The agent of claim 1 having the structure:
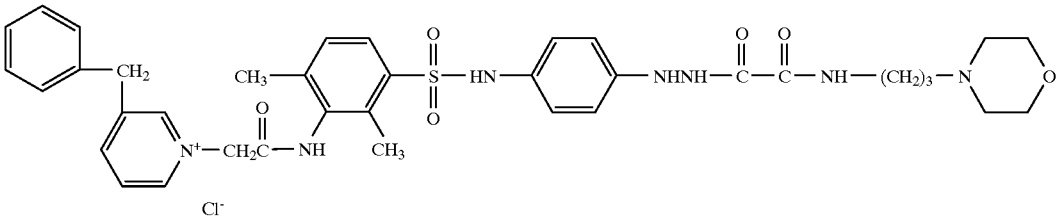
21. The agent of claim 1 having the structure:
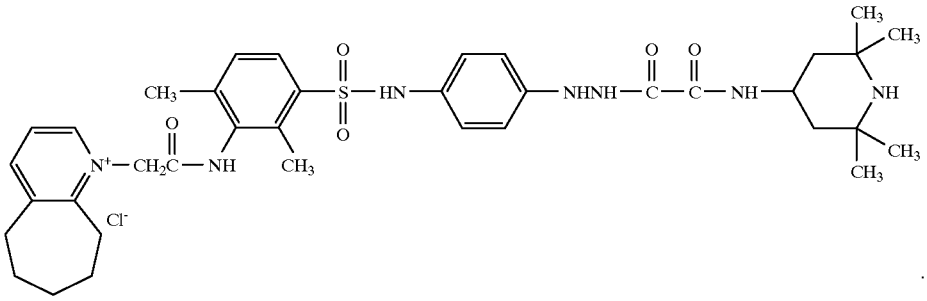
22. The agent of claim 1 having the structure:
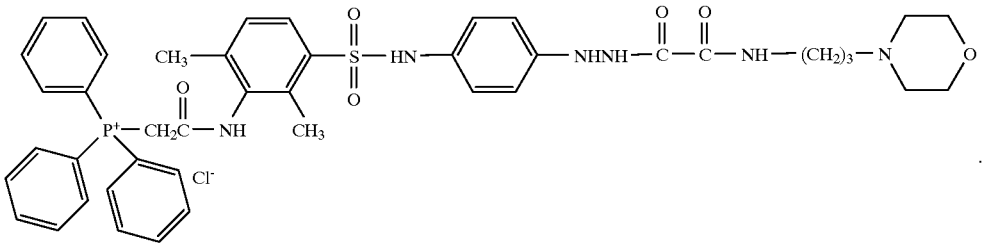

23. The agent of claim 1 having the structure:
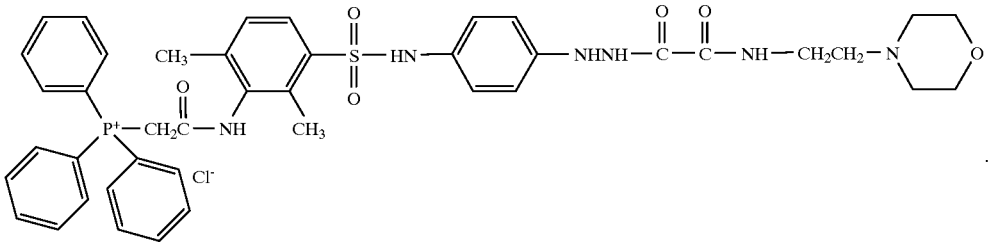
24. The agent of claim 1 having the structure:
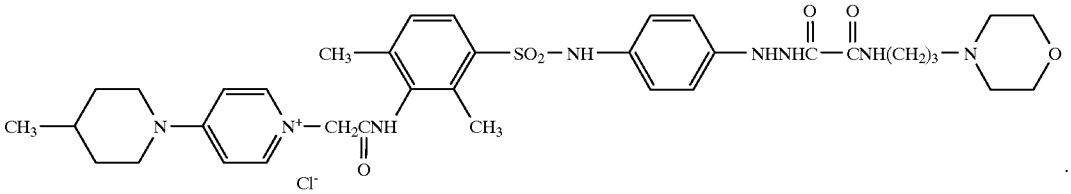
25. The agent of claim 1 having the structure:
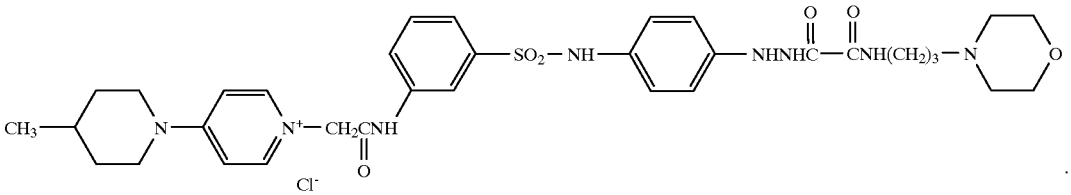
26. The agent of claim 1 having the structure:
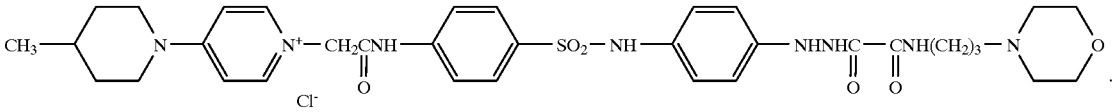
27. The agent of claim 1 having the structure:
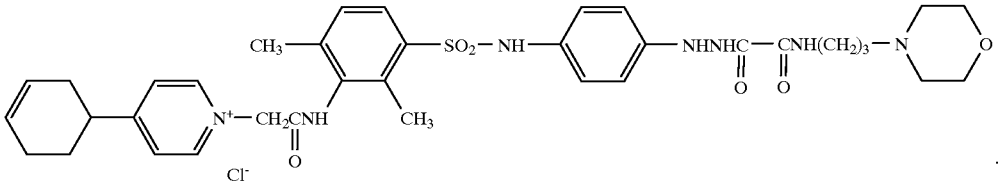

28. The agent of claim 1 having the structure:

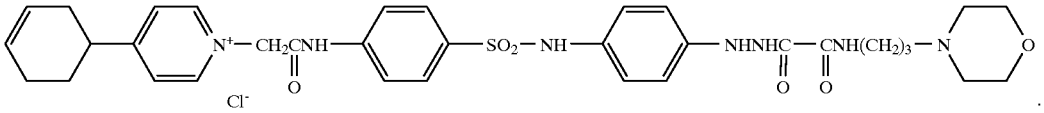

29. The agent of claim 1 having the structure:

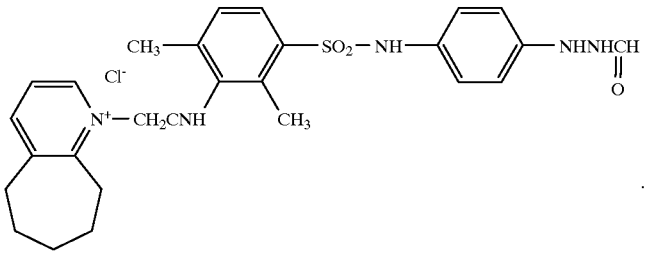

30. The agent of claim 1 in which B is benzyl, E is alkyl-substituted piperidylaminocarbonyl, Y is a group of formula IV, and E is hydrogen or alkyl-substituted piperidylaminocarbonyl.

31. A silver halide photographic element suitable for use as a graphics arts film, the element comprising:

a support;

a layer of light sensitive silver halide emulsion; and a nucleating agent, the nucleating agent having the structure:

I

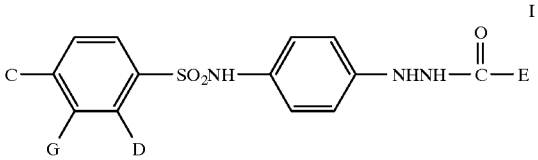

wherein:

C is hydrogen, $C_1$–$C_3$ alkyl, or Z;

D is hydrogen or $C_1$–$C_3$ alkyl;

G is hydrogen or Z;

E is selected from hydrogen, morpholino($C_1$–$C_3$) alkylaminocarbonyl, morpholinoaminocarbonyl, and alkyl-substituted piperidylaminocarbonyl;

Z has the general structure:

II

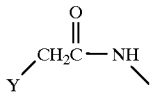

Y has the general structure:

III

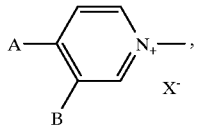

IV

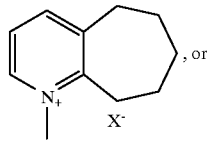

V

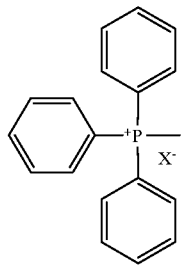

wherein:

A is selected from hydrogen, alkyl, cycloalkenyl, piperidyl, alkylpiperidyl, arylalkyl and $C_4$–$C_{12}$ alkadienyl;

B is selected from hydrogen, unsubstituted benzyl, unsubstituted alkyl, alkoxy substituted benzyl, and halogen substituted benzyl; and X is an inorganic or organic anion;

with the provisos that:

A and B are not both hydrogen;

when C is Z, then D and G are hydrogen; and when G is Z, then C is either hydrogen or $C_1$–$C_3$ alkyl;

when E is hydrogen and G is Z, then A is hydrogen, piperidyl, or alkylpiperidyl.

32. The element of claim 31 in which A is an arylalkyl.

33. A process for forming a high contrast photographic image at high speed comprising:

(a) imagewise exposing a silver halide photographic element and forming an exposed element, the silver halide photographic element comprising:

a support;

a layer of light sensitive silver halide emulsion; and a nucleating agent, the nucleating agent having the structure:

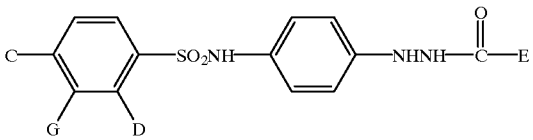

I wherein:

C is hydrogen, $C_1$–$C_3$ alkyl, or Z;

D is hydrogen or $C_1$–$C_3$ alkyl;

G is hydrogen or Z;

E is selected from hydrogen, morpholino($C_1$–$C_3$) alkylaminocarbonyl, morpholinoaminocarbonyl, and alkyl-substituted piperidylaminocarbonyl;

Z has the general structure:

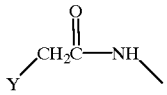

II

Y has the general structure:

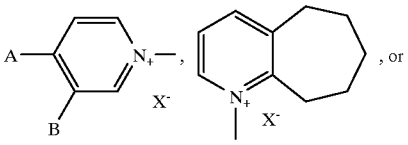

III IV

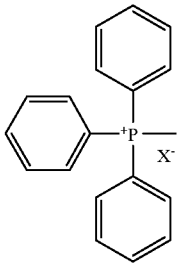

V wherein:

A is selected from hydrogen, alkyl, cycloalkenyl, piperidyl, alkylpiperidyl, arylalkyl and $C_4$–$C_{12}$ alkadienyl;

B is selected from hydrogen, unsubstituted benzyl, unsubstituted alkyl, alkoxy substituted benzyl, and halogen substituted benzyl; and X is an inorganic or organic anion;

with the provisos that:

A and B are not both hydrogen;

when C is Z, then D and G are hydrogen; and when G is Z, then C is either hydrogen or $C_1$–$C_3$ alkyl;

when E is hydrogen and G is Z, then A is hydrogen, piperidyl, or alkylpiperidyl; and (b) developing the exposed element in a developer solution having a pH greater than about 10.

* * * * *